US005724890A

United States Patent [19]

Deschner et al.

[11] Patent Number: 5,724,890

[45] Date of Patent: Mar. 10, 1998

[54] PRINTING PRESS

[75] Inventors: Jürgen Deschner, Leon-Rot; Tobias Müller, Hirschberg, both of Germany

[73] Assignee: Heidelberger Druckmaschinen Aktiengesellschaft, Heidelberg, Germany

[21] Appl. No.: 628,260

[22] Filed: Apr. 5, 1996

[30] Foreign Application Priority Data

Apr. 5, 1995 [DE] Germany ..... 195 12 727.7

[51] Int. Cl.[6] ..... B41F 31/06; B41F 31/08

[52] U.S. Cl. ..... 101/366

[58] Field of Search ..... 101/356, 363, 101/366, 207–210, 148; 118/258, 259; 222/51, 64, 67

[56] References Cited

U.S. PATENT DOCUMENTS

| | | | |
|---|---|---|---|
| 3,780,651 | 12/1973 | Black | 101/115 |
| 3,848,529 | 11/1974 | Gegenheimer et al. | 101/363 |
| 4,099,461 | 7/1978 | Mitter . | |
| 4,787,313 | 11/1988 | Osborn et al. | 101/366 |

FOREIGN PATENT DOCUMENTS

| | | |
|---|---|---|
| 1452762 | 9/1966 | France . |
| 3301153 | 7/1984 | Germany . |
| 9406347 | 7/1994 | Germany . |
| 1472844 | 5/1977 | United Kingdom . |
| 2074240 | 10/1981 | United Kingdom . |
| 2190879 | 12/1987 | United Kingdom . |

*Primary Examiner*—J. Reed Fisher

*Attorney, Agent, or Firm*—Nils H. Ljungman and Associates

[57] ABSTRACT

Generally, the present invention relates to a fluid container in a unit of a printing machine, comprising a device filling a fluid container with fluid, the device being mounted on a carriage so as to be movable to and fro in longitudinal direction of the fluid container, and comprising a device monitoring the fluid level in the fluid container by means of sensors being fastened to the carriage.

14 Claims, 5 Drawing Sheets

PRINTING PRESS

BACKGROUND OF THE INVENTION

1. Field of the Invention

The present invention generally relates to a fluid container in a unit of a printing machine, comprising a device for filling the fluid container with fluid, the device being mounted on a carriage so as to be movable to and fro in the longitudinal direction of the fluid container, and comprising a device for monitoring the fluid level in the fluid container.

The present invention also generally relates to a printing press and a device for feeding a viscous fluid, such as a lacquer or varnish, in such a printing press. The viscous fluid, such as a lacquer or Varnish, can be taken from a cartridge and be distributed to a printed sheet or other suitable medium.

2. Background Information

A fluid container such as that described hereinabove is disclosed in German Patent No. 94 06 347 U, in which a feed pipe, mounted so as to execute a swinging motion, determines the height of the fluid level in the fluid container. This mechanical solution permits pressureless filling of the fluid container with fluid, with the fluid in the fluid container being kept at a minimum level.

OBJECT OF THE INVENTION

Proceeding from this state of the art, an object of the present invention is to regulate the level in the fluid container, the regulation permitting, irrespective of the viscosity of the fluid and of other influences, a precise metering of the fluid according to a respective quantity of fluid required in a respective zone.

SUMMARY OF THE INVENTION

This object, as described hereinabove, can be achieved in that fastened to the carriage is at least one sensor which, in the direction of motion of the device filling the fluid container with fluid, is provided in front of the device, and which sensor controls the fluid if the fluid level is too low. By moving the carriage together with the filling device in longitudinal direction of the fluid container according to this solution, the sensor can detect the fluid level and may supply fluid to certain portions of the fluid container so that a uniformly low fluid level can be obtained. After this measuring and filling motion, with the sensor being switched off, the carriage may be returned to its starting position and is available for a subsequent monitoring of the fluid level.

An advantageous embodiment of the present invention is characterized in that, seen in the direction of motion of the filling device, a respective sensor can be provided on the carriage before and after the filling device. This solution can make it possible to monitor the ink level in both directions of motion of the carriage, thus dispensing with an idle stroke. Given a return of motion, the two sensors can be switched over with respect to the signaling according to a further embodiment of the present invention, so that both sensors may deliver measuring results, for example, regarding the state prior to refilling as well as filling results.

In other words, if the filling device was only provided to dispense ink when the carriage was moving only in one direction, then the other direction of movement of the carriage would be an "idle stroke" movement. The advantageous embodiment described hereinabove would essentially eliminate an idle stroke because the sensors would be able to monitor the ink level in both directions of movement and the ink filling device would be able to dispense ink in both directions of movement.

In a further advantageous embodiment of the present invention, the respective trailing sensor can monitor the quantity of ink supplied and can regulate the supplied quantity as required. This may, for example, be effected by controlling the supply pressure of the ink so that the two signals ensure a very uniform ink level, even in the case of minimum quantities of ink. Of course, the signals delivered by the sensors may also be used to control the velocity of the carriage i.e. when supplying printing ink at a uniform pressure, the velocity of the carriage may be reduced if larger quantities of ink are required, so that in this case, too, it is possible to regulate the quantity of ink supplied to a respective ink zone.

The embodiments of the present invention discussed hereinabove will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

This object, as described hereinabove, can be achieved in that fastened to the carriage is at least one sensor which, in the direction of motion of the device filling the ink fountain with printing ink, is provided in front of the device, and which sensor controls the ink supply if the ink level is too low. By moving the carriage together with the filling device in longitudinal direction of the ink fountain according to this solution, the sensor can detect the ink level and may supply ink to certain portions of the ink fountain so that a uniformly low ink level can be obtained. After this measuring and filling motion, with the sensor being switched off, the carriage may be returned to its starting position and is available for a subsequent monitoring of the ink level.

In summary, one aspect of the present invention resides broadly in a printing press comprising: at least one printing unit comprising: a frame; a plate cylinder being rotatably mounted on said frame; an inking unit for supplying ink to said plate cylinder; a damping unit for supplying damping medium to said plate cylinder; a blanket cylinder having means for being engaged with said plate cylinder; means for feeding sheets, to be printed, to said at least one printing unit; means for directing printed sheets away from said at least one printing unit; means for supplying a liquid, such as a varnish; and said liquid supplying means comprising: means for holding a supply of liquid, such as a varnish; means for detecting the level of a liquid, such as a varnish, being held by said holding means; means for transferring liquid, such as a varnish, from said holding means in said printing press; and means for delivering liquid, such as a varnish, to said holding means upon a predetermined low level range of liquid, such as a varnish, being detected in said holding means by said detecting means.

Another aspect of the present invention resides broadly in a printing press comprising: at least one printing unit comprising: a frame; a plate cylinder being rotatably mounted on said frame; an inking unit for supplying ink to said plate cylinder; a damping unit for supplying damping medium to said plate cylinder; a blanket cylinder having means for being engaged with said plate cylinder; means for feeding sheets, to be printed, to said at least one printing unit; means for directing printed sheets away from said at least one printing unit; means for supplying a viscous liquid; and said liquid supplying means comprising: means for holding a supply of viscous liquid; means for non-contactingly detecting the level of a liquid being held by said holding means by non-contactingly detecting the level between said means for detecting and the liquid; said means for non-contactingly detecting the level of a liquid being disposed to be out of contact with the liquid being held by said holding means; means for transferring liquid from said holding means in said printing press; means for delivering liquid to said holding means upon a predetermined low level range of liquid being detected in said holding means by said detecting means; and means for moving said means for detecting the level of a liquid and said means for delivering liquid to said holding means together across the level of the liquid.

An additional aspect of the present invention resides broadly in a A printing press comprising: at least one printing unit comprising: a frame; a plate cylinder being rotatably mounted on said frame; an inking unit for supplying ink to said plate cylinder; a damping unit for supplying damping medium to said plate cylinder; a blanket cylinder having means for being engaged with said plate cylinder; means for feeding sheets, to be printed, to said at least one printing unit; means for directing printed sheets away from said at least one printing unit; means for supplying a viscous liquid; and said liquid supplying means comprising: means for holding a supply of viscous liquid; means for non-contactingly detecting the level of a liquid being held by said holding means; means for transferring liquid from said holding means in said printing press; and means for delivering liquid to said holding means upon a predetermined low level range of liquid being detected in said holding means by said detecting means.

BRIEF DESCRIPTION OF THE DRAWINGS

The present invention is described in greater detail below with reference to various embodiments which are schematically illustrated in the accompanying drawings, wherein.

DESCRIPTION OF THE PREFERRED EMBODIMENT

Figure 1:
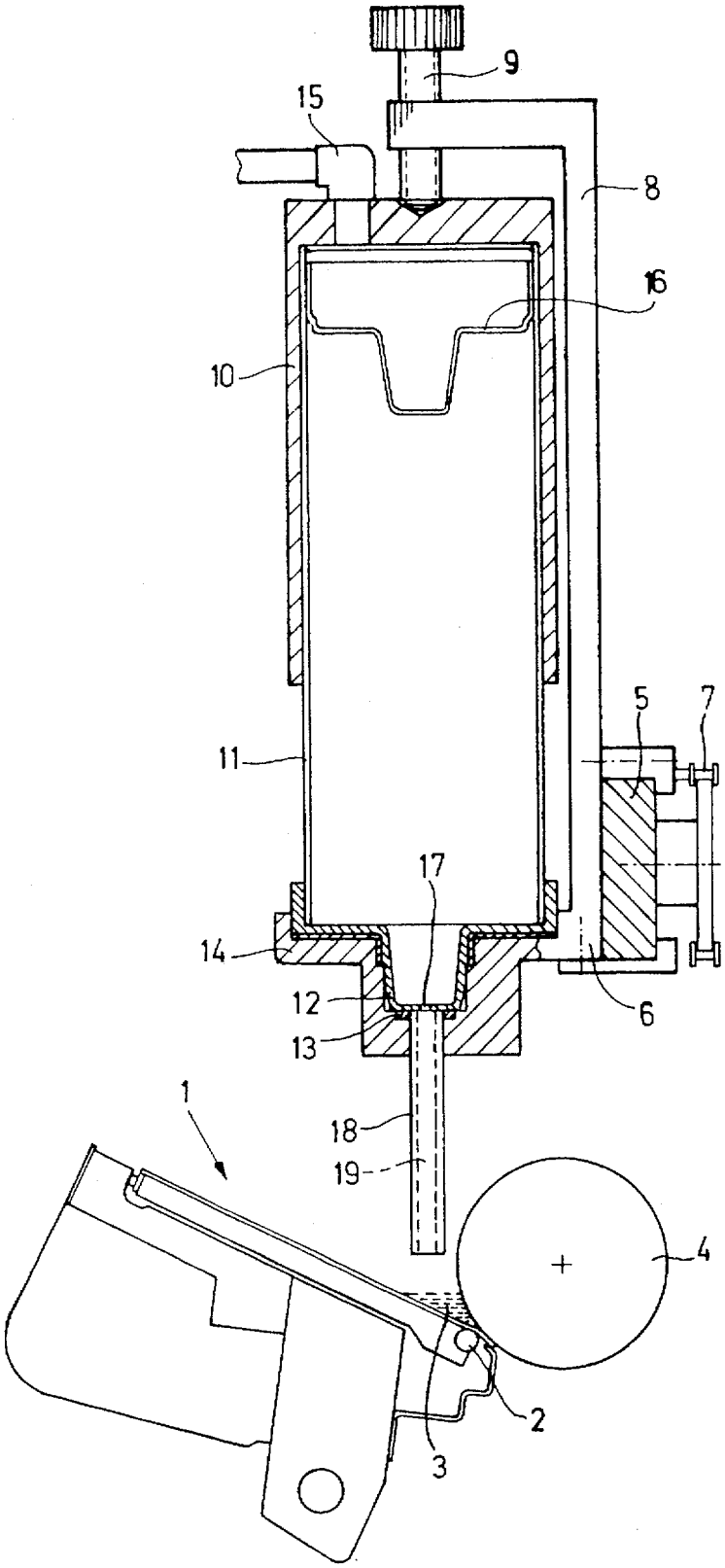
FIG. 1 is a cross-sectional view of a device.

As illustrated in FIG. 1, in an ink fountain 1 having an ink-metering device 2, is located a small ink reservoir 3. The ink-metering device 2 produces on an ink-fountain roller 4 an ink profile, which ink profile can be transmitted into the inking unit of the printing machine.

A carriage 6 being movable to and fro via a drive 7 over the length of the ink fountain 1 can be guided on a traverse member 5 secured between the machine side frames. Within the carriage 6 a cap 10 can be urged onto a cartridge 11, via an arm 8 and a clamping screw 9, so that the cartridge 11 with its mouthpiece 12 can be pressed, through the intermediary of a seal 13, onto a receptacle 14 of the carriage 6. Via a compressed-air connection 15, the bottom 16 of the cartridge 11 may be moved downwards through an adjustable pressure, so that ink may leave through outlet 17. Below the cartridge 11 a supply pipe 18 can be fastened to the carriage 6, the opening 19 of the supply pipe 18 being aligned with the outlet 17.

Due to the pressure of the compressed air being supplied through the compressed-air connection 15, ink may be conveyed into the ink fountain 1. When changing inks, preferably only the cartridge 11 with the cap 10 has to be removed from the carriage 6, by untightening the clamping screw 9, and replaced by a new cartridge 11. At impression throw-off no printing ink is needed; in this case, one essentially only has to switch off the compressed air supplied through the compressed-air connection 15, so that no further ink may get into the ink fountain 1.

Figure 1A:
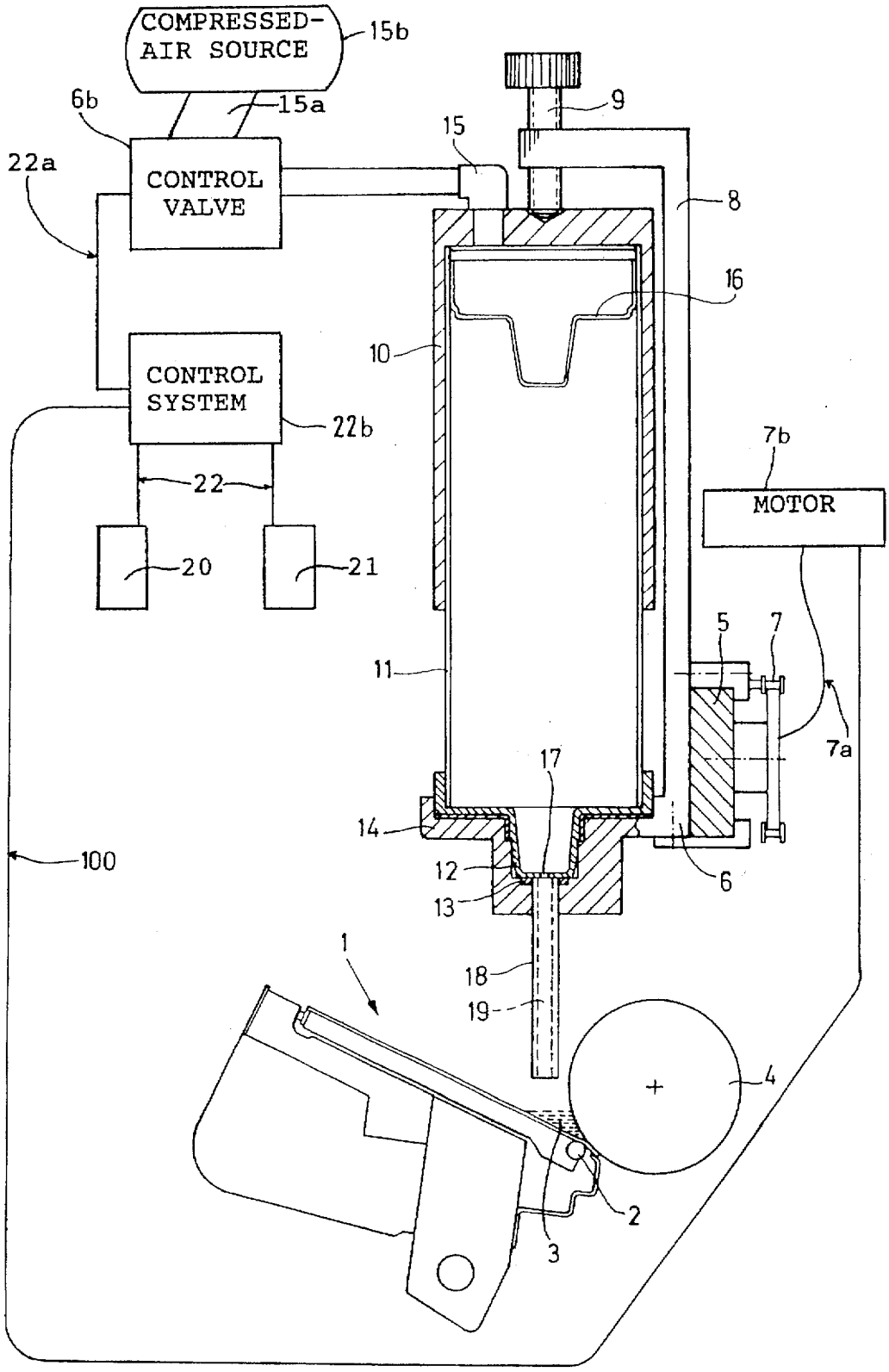
FIG. 1*a* is essentially the same as FIG. 1, but is more detailed.

FIG. 1*a* schematically illustrates an embodiment of the present invention in which a compressed-air source 15*b* supplies compressed air through air supply connection 15*a* to a control valve 6*b*. The control valve 6*b* can be connected to the control system 22*b* by a data transfer line 22*a* in order to suitably manipulate the control valve 6*b*. The control valve 6*b*, in turn, regulates the compressed air moving through the air supply connection 15, which air supply connection 15 supplies compressed air to the bottom 16 of the cartridge 11. There can be sensors 20 and 21 connected by electrical lines 22 to the control system 22*b* for data transfer from the sensors 20, 21 to the control system 22*b*. (Sensors 20, 21 are discussed further below in more detail with relation to FIG. 2). Data, according to this embodiment of the present invention, can be manually input to the control system 22*b*. Manual input to the control system 22*b* can include remote control input. The control system 22*b* can also process information received automatically from the sensors 20, 21 and other suitable components. The control system 22*b*, in this case, can control the sensors 20, 21, the control valve 6*b*, and other appropriate components. With the control system 22*b* possibly incorporating a learning process and pattern recognition system therein, an essentially reliable, accurate, and detailed ink profile can be produced by an ink-metering device 2 on an ink-fountain roller 4, which ink profile can be transmitted into the inking unit (not shown) of the printing machine. A motor 7*b* can be connected by a connecting means 7*a* to the drive 7, which drive 7 moves the carriage 6. The motor 7*b* can be a hi-directional motor.

Referring once more to FIG. 1*a*, the carriage 6 can be driven by connection 7*a*, which connection 7*a* can be driven by the motor 7*b*. The motor 7*b* can be, in turn, controlled by the control system 22*b*. Transfer of data between the motor 7*b* and the control system 22*b* can be through data transfer line 100.

Figure 2:
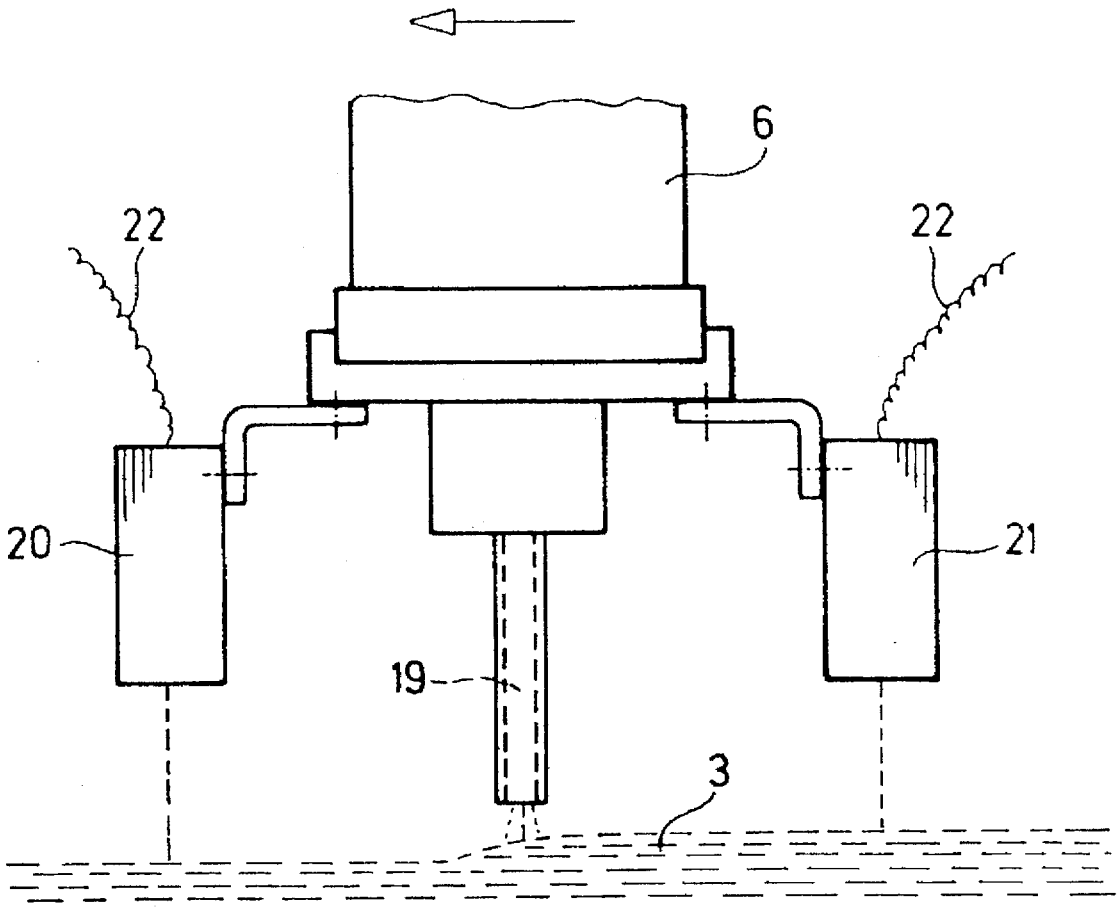
FIG. 2 shows a partial cross-section of the carriage with the sensors.

FIG. 2 shows a carriage 6 moving, for example, towards the left, over the ink reservoir 3 along the ink fountain 1 (not shown in FIG. 2). In the embodiment shown, a respective sensor 20, 21 can be fastened to each side of the carriage 6, with the leading sensor 20 determining the actual state of the ink reservoir 3 in the individual areas. The leading sensor 20 can deliver a signal to the compressed-air supply system if the ink in the ink reservoir 3 is too small, so that ink is refilled. The trailing sensor 21 can determine the result, i.e. the ink level after an ink refill and, if necessary, may effect corrections following a signal, which signal may indicate that ink is needed. If ink is to be refilled with respect to both directions of motion, the signaling of the two sensors 20, 21 can be switched over given a return of motion. The ink may be refilled at intervals. Via electrical lines 22 both sensors 20, 21 can be connected to an electronic control system controlling the compressed air and/or the velocity of motion as well as the intervals of motion of the carriage 6. That is, the function of sensors 20, 21 will change depending on which direction the carriage 6 is moving.

The carriage 6, depicted in FIG. 2, can essentially have two directions of movement. Referring to the page of the drawing, the first direction of movement can be movement of the carriage 6 from the right side of the drawing toward the left side of the drawing; the second direction of movement of carriage 6 can be from the left side of the drawing toward the right side of the drawing. As the carriage 6 can move in the first direction, sensor 20 can essentially be a leading sensor, and the sensor 21 can essentially be the trailing sensor. The sensor 20, in this case, can detect the level of the ink in the ink reservoir 3 and relay data concerning the level of ink in the ink reservoir 3 so that, if ink is needed in reservoir 3, ink will be dispensed from opening 19 to bring the ink level in the reservoir 3 to an appropriate level. The sensor 21, in this case, is a trailing sensor, and can detect the level of the ink in the reservoir 3 after dispensation of ink into the reservoir 3. The data relayed from sensor 21 is then processed, and any adjustments which may be necessary can be immediately taken care of. Adjustments in levels of ink in the reservoir 3 can be made by variations in the pressure of the compressed air supplied to the bottom 16 of the cartridge 11 (shown in FIGS. 1 and 1*a*).

In the second direction of movement of the carriage 6, the functions of sensors 20, 21 are essentially switched; that is, as the carriage 6 moves in the second direction of movement, the sensor 21 can become the leading sensor and can perform as sensor 20 would have during movement in the first direction of movement. Sensor 20, of course, during movement in the second direction of movement can be the trailing sensor, and would function as the trailing sensor. The use of two sensors 20, 21, with dual and switchable functions, such as described herein and hereinabove, can make the inking unit of a printing machine more efficient and accurate in that, since the ink level in the reservoir 3 can be monitored in both directions of movement of the carriage 6, and likewise ink can be delivered to the reservoir 3, an idle stroke (or return movement) of the carriage 6 can be essentially eliminated.

A more detailed discussion is now offered, wherein the carriage 6 with the sensors 20, 21, as shown in FIG. 2, can begin movement in the first direction of movement (as described further above) at a position corresponding to the far right side of the page of FIG. 2. The sensors 20, 21 can accordingly be moved across the level of the reservoir 3 to detect the level of the liquid in the reservoir 3. During movement in the first direction, the leading sensor can be sensor 20. Sensor 20 can detect any level variations of ink and can relay such data to the control system 22*b* (shown in FIG. 1*a*). The control system 22*b* can send pertinent data, then, to various components which can make appropriate modifications. The control valve 6*b* (shown in FIG. 1*a*) may receive information, for example, that the ink level in the reservoir 3 is too low at a particular location. The control valve 6*b*, in this case, would then allow air pressure from the compressed-air source 15*b* (shown in FIG. 1*a*) to be increased in order to move the bottom 16 of the cartridge 11 (shown in FIGS. 1 and 1*a*) to dispense an appropriate amount of ink through the supply pipe 18 into the reservoir 3.

It can be possible that the ink supplied at a particular location may be insufficient; the sensor 21, as the trailing sensor, can detect any low levels in the reservoir 3 during dispensation of ink in the first direction of movement. In this situation, the sensor 21 can signal the control system that ink is needed.

If the level of ink in a particular location in the reservoir 3 would be below a suitable level, the control system 22*b* can receive a corresponding signal from a sensor 20, 21, and the control system 22*b* can relay a signal to the control valve 6*b* to increase the supplied compressed air to increase dispensing of ink into the reservoir 3. The carriage 6 can then move on to finish movement in the first direction. Upon completing movement in the first direction, the carriage 6 can begin movement in the second direction of movement. During movement in the second direction, the functions of the sensors 20, 21 can essentially be reversed; that is, the sensor 21 can become the leading sensor, functioning as sensor 20 did during movement in the first direction, and the sensor 20 can become the trailing sensor and can function as sensor 21 did during movement in the first direction.

If the level of ink in a particular location in the reservoir 3 would be above a suitable level, the control system 22*b* can receive a corresponding signal from a sensor 20, 21, and the control system 22*b* can relay a signal to the control valve 6*b* to decrease the supplied compressed air to slow dispensing of ink into the reservoir 3, or stop the supply of compressed air altogether in order that ink dispensation is stopped. The carriage 6 can then move on to finish movement in the first direction. Upon completing movement in the first direction, the carriage 6 can begin movement in the second direction of movement. During movement in the second direction, the functions of the sensors 20, 21 can essentially be reversed; that is, the sensor 21 can become the leading sensor, functioning as sensor 20 did during movement in the first direction, and the sensor 20 can become the trailing sensor and can function as sensor 21 did during movement in the first direction.

The sensors 20, 21 and the control system 22*b* can work as a feedback system to maintain the ink level at a desired height.

In yet another embodiment of the present invention, and referring to FIG. 2, the control system 22*b* (shown in FIG. 1*a*) can either reverse the direction of movement of the carriage 6 (by signalling the motor 7*b*, shown in FIG. 1*a*) so that ink can be supplied to the ink-deficient location, or the carriage 6 can complete travel in the first direction and then ink can be supplied to the ink-deficient location during movement of the carriage 6 in the second direction of movement (as described further above). The control system 22*b*, using pattern recognition, can ascertain whether it would be more efficient to dispense ink at the ink-deficient location during movement in the second direction (upon completing first-direction movement and first-direction detecting by the sensors 20, 21), or to have ink dispensed during a minor reversal from movement in the first direction to movement in the second direction. After dispensing ink during this minor reversal, the control system 22*b*, then, can be signalled by one or both of the sensors 20, 21 that the ink dispensed is sufficient.

Additionally, in accordance with at least one embodiment of the present invention, a flow sensing unit can be combined with a control valve 6*b* and a control system 22*b* (shown in FIG. 1*a*) to control the flow of ink. With a configuration such as this, the flow rate of ink, or other viscous fluid, can be electronically sensed and controlled. Microprocessor control system 22*b* can monitor parameters including pressure of the compressed air supplied by the compressed-air connection 15, the type of ink, flow rate of ink being supplied to supply pipe 18, air temperature of the immediate area, humidity, temperature of the ink, viscosity, and ink flow volume. The data received and processed by the control system **22*b* can be immediately used, in conjunction with data from sensors 20 and 21 to accurately and evenly distribute ink in the ink reservoir 3**.

In accordance with at least one embodiment of the present invention, the compilation of data can be displayed, for instance, on a CRT (cathode ray tube) monitor or LCD (liquid crystal display) apparatus. Garnered data, including data such as that discussed herein and further above, can be useful in pattern recognition systems, particularly pattern recognition systems involving learning processes. The pattern, in this case, including electronically garnered data and manually input data, wherein the manual input can be by remote control.

In another embodiment of the present invention, optic, ultrasonic, or microwave sensors can be used as the sensors 20 and 21, and suitable data from the sensors 20 and 21 can be relayed to an electronically controlled flow valve located in the supply pipe 18.

Figure 3:
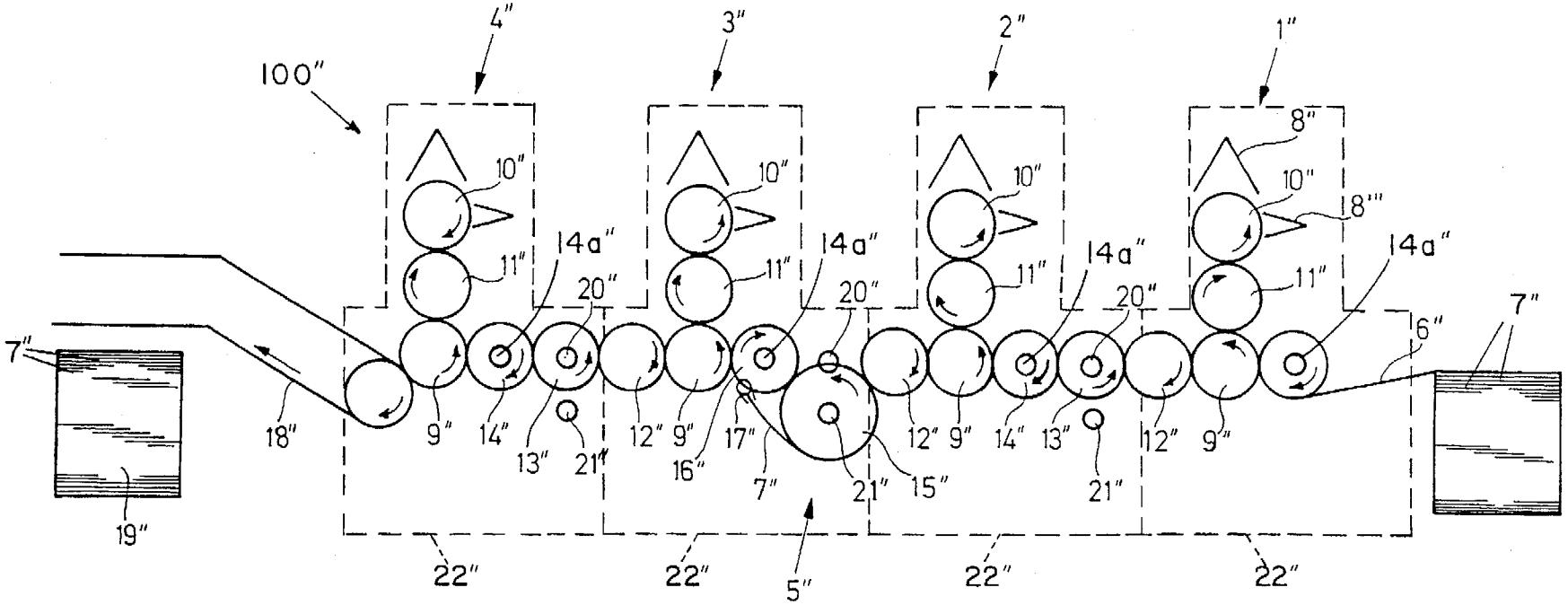
FIG. 3 illustrates a multi-unit printing press in which the present invention may be employed.
Figure 4:
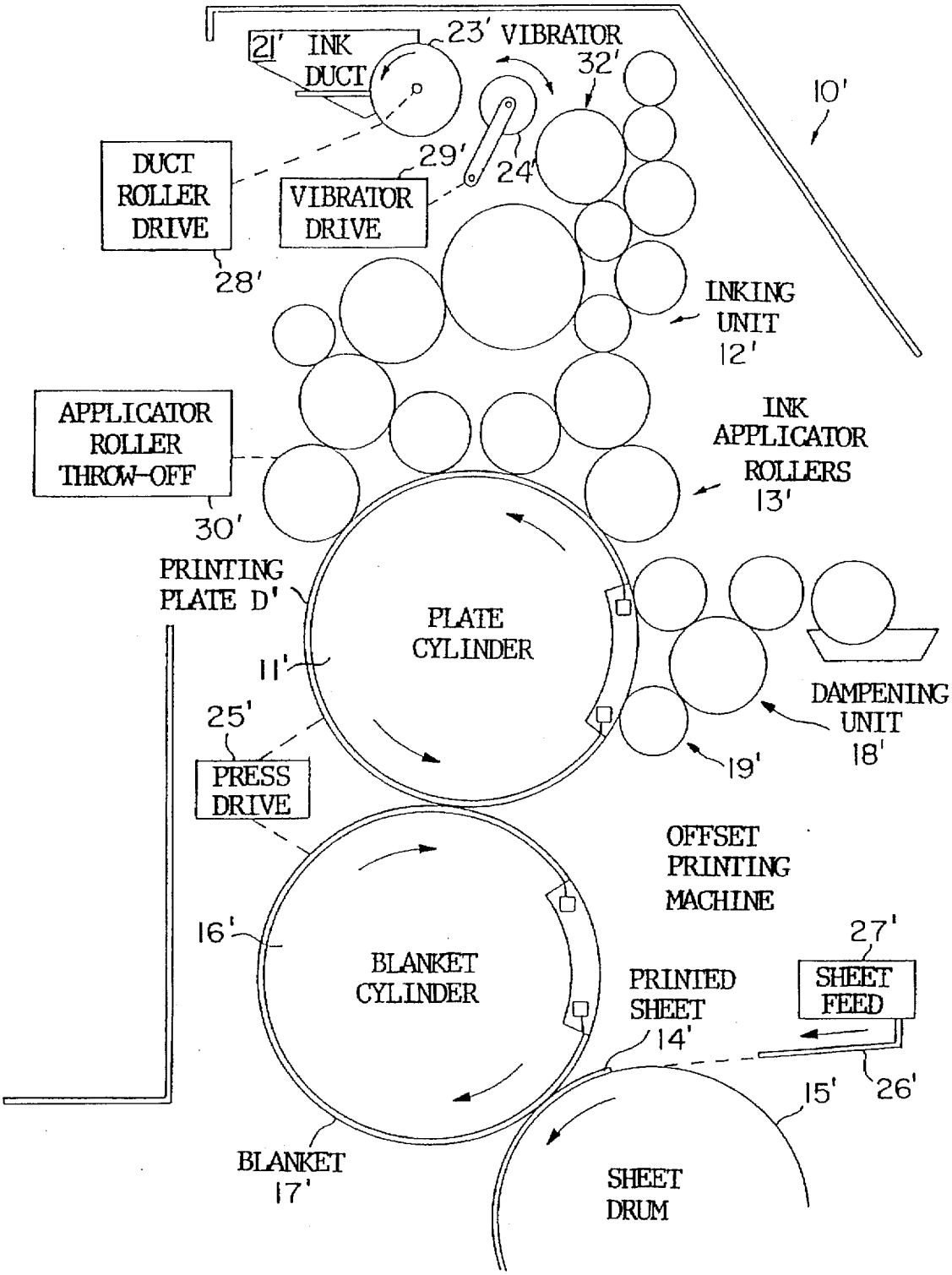
FIG. 4 illustrates a print stand of a rotary printing press in which the present invention may be employed.

The disclosure now turns to an example of a printing press in which the present invention, in accordance with at least one preferred embodiment, may be employed, as shown in FIGS. 3 and 4. It should be understood that components discussed herebelow with reference to FIG. 3, if appropriate, may be considered to be interchangeable with similar components discussed hereinabove with respect to FIGS. 1, **1*a*, and 2 and further below with respect to FIG. 4**.

FIG. 3 schematically illustrates a multi-unit printing press 100" in which at least one embodiment of the present invention may be employed. Particularly, a multi-unit printing press 100" may typically include a plurality of printing units, such as four printing units 1", 2", 3", and 4". Each printing unit may typically include a support frame arrangement The sheets 7" to be processed can preferably be fed from a supply stock to the impression cylinder 9" of a first printing unit 1" by sheet feeder 6". Each sheet 7" can preferably receive its first ink application by means of plate cylinder 10" and blanket cylinder 11" of printing unit 1". Accordingly, each subsequent printing unit 2", 3", and 4" can also typically include its own plate cylinder 10" and blanket cylinder 11". Typically, an inking unit 8" and damping unit 8'" can be assigned to each plate cylinder 10".

Other components illustrated in FIG. 3, but not otherwise described herein, are discussed in U.S. Pat. No. 5,016,529 which issued May 21, 1991 to Jahn, and is incorporated by reference herein.

FIG. 4 illustrates a rotary print stand 10' of a rotary printing press in which at least one embodiment of the present invention may be employed. Rotary print stand 10' generally includes: a plate cylinder 11' for having mounted thereon a printing plate D'; an inking unit 12' which includes ink applicator rollers 13' for applying to the printing plate D' an ink profile; a dampening (or wetting) unit 18' having dampening applicator rollers 19' for transferring a dampening agent to the printing plate D', a blanket cylinder 16' carrying a rubber blanket 17' for receiving an ink impression from the printing plate D', and a sheet drum 15' for carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' and deposit the same on a roller 32' of inking unit 12'. Typically, the printing stand 10' will also include auxiliary mechanisms such as, for example, a duct roller drive 28', a vibrator roller drive 29' an applicator roller throw-off 27" for lifting the ink applicator rollers 13' off the printing plate, a press drive 25', and a sheet feed 27' for supplying the sheets to be printed 26' to sheet drum 15'.

It should be understood that the components and methods discussed above with relation to FIG. 4 may, if appropriate, essentially be considered to be interchangeable with similar components and methods discussed further above with relation to FIGS. 1, **1*a*, 2, and 3**.

Furthermore, it should be understood that the arrangement described and illustrated with respect to FIGS. 1, **1*a*, 2, 3, and 4** hereinabove can be used in other contexts, such as in a lacquering, coating or varnishing unit of a printing press. In this respect, the fluid medium in question can be lacquer or varnish instead of ink. The general operation and makeup of such lacquering, coating or varnishing units will be well-known to those of ordinary skill in the printing arts and, as such, will not be described further herein. However, further details regarding such lacquering and drying stations can be found in the following two publications, both published by Heidelberger Druckmaschinen Aktiengesselschaft (Heidelberg, Germany), which are hereby incorporated by reference into the instant specification: "Lackieren und Trocknen", designated with the reference Heidelberger Nachrichten (HN) March 1949; and "Heidelberg M-Offset CP-Tronic", designated with the reference HN January 1949.

One feature of the invention resides broadly in the ink fountain in an inking unit of a printing machine, comprising a device filling an ink fountain with printing ink, the device being mounted on a carriage so as to be movable to and fro in longitudinal direction of the ink fountain, and comprising a device monitoring the ink level in the ink fountain, characterized in that to a carriage 6 is fastened at least one sensor 20, 21 which, seen in direction of motion of an ink-filling device, is provided before the ink-filling device and controls the ink supply if the ink level is too low.

Another feature of the invention resides broadly in the ink fountain characterized in that, seen in direction of motion of the ink-filling device, a respective sensor 20, 21 is disposed on the carriage 6 before and after the ink-filling device.

Yet another feature of the invention resides broadly in the ink fountain characterized in that, given a return of motion of the carriage 6, the two sensors 20, 21 are switched over with respect to the signaling.

Still another feature of the invention resides broadly in the ink fountain characterized in that the respective trailing sensor 20, 21 monitors the quantity of ink supplied 3 and regulates the supplied quantity.

In recapitulation, the present invention generally relates to an ink fountain in an inking unit of a printing machine, comprising a device for filling the ink fountain with printing ink, the device being mounted on a carriage so as to be movable to and fro in the longitudinal direction of the ink fountain, and comprising a device for monitoring the ink level in the ink fountain.

An ink fountain such as that described hereinabove is disclosed in German Patent No. 94 06 347 U, in which a feed pipe, mounted so as to execute a swinging motion, determines the height of the ink level in the ink fountain. This mechanical solution permits pressureless filling of the ink fountain with ink, with the ink reservoir in the ink fountain being kept at a minimum level.

Proceeding from this state of the art, an object of the present invention is to regulate the ink level in the ink fountain, the regulation permitting, irrespective of the viscosity of the ink and of other influences, a precise metering of the ink according to a respective quantity of ink required in a respective zone.

Generally, the present invention relates to An ink fountain in an inking unit of a printing machine, comprising a device filling an ink fountain with printing ink, the device being mounted on a carriage so as to be movable to and fro in longitudinal direction of the ink fountain, and comprising a device monitoring the ink level in the ink fountain by means of sensors being fastened to the carriage.

What is claimed is:

1. An ink fountain for the inking unit of a rotary printing press said ink fountain comprising:

a filling device for filling said ink fountain with ink;

a carriage for mounting said filling device;

an elongated beam;

mounting structure for mounting said carriage on said elongated beam to permit said carriage to move along said elongated beam;

said carriage being movably mounted on said elongated beam with said mounting structure;

said filling device being mounted on said carriage;

a monitoring device for monitoring the ink level in said ink fountain, said monitoring device comprising:

at least one sensor;

said at least one sensor having a sensing structure to determine the ink level in said ink fountain;

said at least one sensor being firmly attached to and being movable with said carriage to move along with said filling device; and said at least one sensor being connected to said filling device to actuate said filling device to supply ink to said ink fountain upon said at least one sensor sensing an ink level below a predetermined ink level;

said rotary printing press comprising a plurality of rollers;

said plurality of rollers comprising:

a plurality of ink application rollers;

a plate cylinder;

a blanket cylinder; and a sheet drum;

said ink fountain comprising:

an ink fountain roller;

an ink metering device for producing an ink profile on said ink fountain roller; and an ink reservoir to supply ink to said ink metering device;

said filling device having a first direction of travel along said elongated beam;

said at least one sensor being disposed to move with said filling device in said first direction of travel and being disposed to precede said filling device upon movement of said filling device in said first direction of travel;

said monitoring device comprising at least two sensors;

said at least two sensors being a first sensor and a second sensor;

said second sensor of said at least two sensors being firmly attached to said carriage; and said second sensor being disposed to move with said filling device in said first direction of travel and being disposed to follow said filling device upon movement of said filling device in said first direction of travel.

2. The ink fountain as claimed in claim 1 wherein:

said second sensor is disposed to sense the amount of ink supplied by said filling device to said ink fountain upon movement of said filling device in said first direction of travel; and said second sensor is connected to said filling device to control the amount of ink supplied by said filling device to said ink fountain upon movement of said filling device in said first direction of travel.

3. The ink fountain as claimed in claim 2 wherein:

said filling device has a second direction of travel along said elongated beam; and said second direction of travel is opposite said first direction of travel.

4. The ink fountain as claimed in claim 3 wherein said second sensor is disposed to precede said filling device in said second direction of travel.

5. The ink fountain as claimed in claim 4 wherein said second sensor is connected to said filling device to actuate said filling device to supply ink to the ink fountain upon said second sensor sensing an ink level below a predetermined ink level upon movement of said filling device in said second direction of travel.

6. The ink fountain as claimed in claim 5 wherein said first sensor is disposed to follow said filling device upon movement of said filling device in said second direction of travel.

7. The ink fountain as claimed in claim 6 wherein:

said first sensor is disposed to sense the amount of ink supplied by said filling device to said ink fountain upon movement of said filling device in said second direction of travel; and said first sensor is connected to said filling device to control the amount of ink supplied by said filling device to said ink fountain upon movement of said filling device in said second direction of travel.

8. A filling device for filling the ink fountain of an inking unit of a rotary printing press comprising an inking unit with a plurality of inking rollers, an ink fountain, said ink fountain comprising an ink reservoir, an ink metering device and an ink fountain roller, said filling device comprising:

a carriage for mounting said filling device;

an elongated beam;

mounting structure for mounting said carriage on said elongated beam to permit said carriage to move along said elongated beam;

said carriage being movably mounted on said elongated beam with said mounting structure;

said filling device being mounted on said carriage;

a monitoring device for monitoring the ink level in the ink fountain;

said monitoring device comprising:

at least one sensor;

said at least one sensor comprising a sensing structure to determine the ink level in the ink fountain;

said at least one sensor being firmly attached to and being movable with said carriage to move along with said filling device; and said at least one sensor being connected to said filling device and being configured to actuate said filling device to supply ink to the ink fountain upon said at least one sensor sensing an ink level below a predetermined ink level;

said filling device having a first direction of travel along said elongated beam;

said at least one sensor being disposed to move with said filling device in said first direction of travel and being disposed to precede said filling device upon movement of said filling device in said first direction of travel;

said monitoring device comprising at least two sensors;

said at least two sensors being a first sensor and a second sensor;

said second sensor being firmly attached to said carriage; and said second sensor being disposed to move with said filling device in said first direction of travel and being disposed to follow said filling device upon movement of said filling device in said first direction of travel.

9. The filling device as claimed in claim 8 wherein said second sensor is disposed to sense the amount of ink supplied by said filling device to said ink fountain upon movement of said filling device in said first direction of travel.

10. The filling device as claimed in claim 9 wherein said second sensor is connected to said filling device and is configured to control the amount of ink supplied by said filling device to the ink fountain upon movement of said filling device in said first direction of travel.

11. The filling device as claimed in claim 10 wherein:

said filling device has a second direction of travel along said elongated beam; and said second direction of travel is opposite said first direction of travel.

12. The filling device as claimed in claim 11 wherein said second sensor is disposed to precede said filling device in said second direction of travel.

13. The filling device as claimed in claim 12 wherein said second sensor is connected to said filling device and is disposed to actuate said filling device to supply ink to the ink fountain upon said second sensor sensing an ink level below a predetermined ink level upon movement of said filling device in said second direction of travel.

14. The filling device as claimed in claim 13 wherein:

said first sensor is disposed to follow said filling device upon movement of said filling device in said second direction of travel;

said first sensor is disposed to sense the amount of ink supplied by said filling device to said ink fountain upon movement of said filling device in said second direction of travel; and said first sensor is connected to said filling device and is configured to control the amount of ink supplied by said filling device to said ink fountain upon movement of said filling device in said second direction of travel.

* * * * *

UNITED STATES PATENT AND TRADEMARK OFFICE

CERTIFICATE OF CORRECTION

PATENT NO. : 5,724,890

DATED : March 10, 1998

INVENTOR(S) : Jürgen DESCHNER and Dr. Tobias MÜLLER

It is certified that error appears in the above-identified patent and that said Letters Patent is hereby corrected as shown below:

In column 7, lines 36-37, after 'arrangement' insert --22".--.

Signed and Sealed this

Twenty-fifth Day of August, 1998

Bruce Lehman

*Attest:*

BRUCE LEHMAN

*Attesting Officer*

*Commissioner of Patents and Trademarks*